US005997387A

United States Patent [19]

Imai et al.

[11] Patent Number: 5,997,387

[45] Date of Patent: Dec. 7, 1999

[54] GRINDING WHEEL WITH AT LEAST TWO WHEEL CORES FOR CIRCUMFERENTIAL GRINDING

[75] Inventors: Tomoyasu Imai, Kariya; Ryouhei Mukai; Hideki Nagano, both of Nagoya; Koji Nishi, Anjo; Hisashi Nakamura, Nagoya; Masahiro Ido, Kariya; Yutaka Hayashi, Chiryu; Eiji Fukuta; Satoshi Yamaguchi, both of Aichi-ken, all of Japan

[73] Assignee: Toyoda Koki Kabushiki Kaisha, Kariya, Japan

[21] Appl. No.: 09/018,618

[22] Filed: Feb. 4, 1998

[30] Foreign Application Priority Data

Feb. 5, 1997 [JP] Japan ..... 9-022854
Feb. 18, 1997 [JP] Japan ..... 9-033882

[51] Int. Cl.[6] ..... B24B 41/00

[52] U.S. Cl. ..... 451/65; 451/342; 451/343

[58] Field of Search ..... 451/342, 343, 451/65, 57; 74/432; 403/11

[56] References Cited

U.S. PATENT DOCUMENTS

| | | | |
|---|---|---|---|
| 2,244,057 | 6/1941 | Ekholm | 451/342 |
| 2,887,830 | 5/1959 | Else . | |
| 3,646,711 | 3/1972 | Oishi et al. | 451/342 |
| 3,656,393 | 4/1972 | Goellner | 83/666 |
| 3,827,193 | 8/1974 | Liebermann et al. | 451/343 |
| 4,998,384 | 3/1991 | Bouchard et al. | 451/342 |
| 5,042,207 | 8/1991 | Kirn | 451/342 |
| 5,545,078 | 8/1996 | Schulz et al. | 451/342 |
| 5,580,301 | 12/1996 | Muller | 451/342 |
| 5,651,726 | 7/1997 | Skogsberg | 451/342 |
| 5,658,192 | 8/1997 | Reinauer | 451/342 |

FOREIGN PATENT DOCUMENTS

| | | | |
|---|---|---|---|
| 27 32 271 | 1/1979 | Germany . | |
| 58-186560 | 10/1983 | Japan . | |
| 6-190729 | 7/1994 | Japan . | |
| 7-40237 | 2/1995 | Japan . | |
| WO 88/05366 | 7/1988 | WIPO | 451/342 |

*Primary Examiner*—David A. Scherbel
*Assistant Examiner*—Lee Wilson
*Attorney, Agent, or Firm*—Oblon, Spivak, McClelland, Maier & Neustadt, P.C.

[57] ABSTRACT

A grinding wheel is for use in a grinding machine, and is attached on a wheel spindle of the grinding machine for simultaneously grinding at least two parts of a workpiece. The grinding wheel includes at least two wheel cores. Each of wheel cores has a disk-like shape. An abrasive layer is disposed on a circumferential surface of each of the wheel cores. A spacer portion is inseparably fixed on at least one of the wheel cores for keeping a space between the abrasive layers of the wheel cores. And a first labyrinth portion located on one of side surfaces of one of the wheel cores for forming a labyrinth seal with a second labyrinth portion arranged on the grinding machine. The number of separable parts of the grinding wheel are extremely decreased in consideration of imbalance of every part. The spacer portion is integral with at least one of the wheel cores. Since the grinding wheel is easily accurately balanced, vibration of the grinding wheel is decreased and stability is enhanced when the wheel spindle is driven at very high speed. As a result, machining accuracy for grinding is enhanced.

30 Claims, 9 Drawing Sheets

GRINDING WHEEL WITH AT LEAST TWO WHEEL CORES FOR CIRCUMFERENTIAL GRINDING

BACKGROUND OF THE INVENTION

1. Field of the Invention

The present invention relates to a grinding wheel used in a grinding machine and the like. More particularly, the present invention relates to a grinding wheel for simultaneously grinding at least two parts of a workpiece.

2. Description of the Prior Art

FIG. 1 shows an example of conventional grinding wheels for simultaneously grinding two parts of a workpiece. The grinding wheel Gc2 is supported on a wheel spindle 8 of a wheel head 2 in a grinding machine 1. The grinding wheel Gc2 includes a sleeve 15, two wheel disks Gca and Gcb supported on the sleeve 15, a spacer 25 located between the wheel disks Gca and Gcb, and a flange 28 for fixing the wheel disks Gca and Gcb on the sleeve 15 by bolts 35. The sleeve 15 has a taper bore 17 formed at the center portion of the grinding wheel Gc2. The taper bore 17 receives a taper portion 9 of the wheel spindle 8, and the grinding wheel Gc2 is engaged on the wheel spindle 8 by a nut 32. A labyrinth seal 34 is formed between the sleeve 15 and the wheel head 2 to prevent grinding fluid from leaking into the wheel head 2. Each of the wheel disks Gca and Gcb consists of a wheel core 11 and an abrasive layer 12 arranged on a circumferential surface of the wheel core 11 for grinding work.

In recent years, a need exists for increase of wheel surface speed of a grinding wheel in order to decrease machining time. However, the grinding wheel Gc2 has a drawback when the wheel spindle 8 is driven at very high speed, e.g., the wheel surface speed is approximately 200 m/s, as described hereinafter. Though the wheel disks Gca and Gcb are balanced, it is difficult that the other parts of the grinding wheel Gc2, i.e., the sleeve 15, the spacer 25, the flange 28 and the like, are sufficiently balanced. The imbalance of the parts increases in accordance with the wheel surface speed of a grinding wheel Gc2. The drawback causes vibration of the wheel disks Gca and Gcb, while the grinding wheel Gc2 is working, making machining accuracy deteriorate.

FIG. 2 shows an example of conventional grinding wheels for grinding work under high wheel surface speed. The grinding wheel is shown in a Japanese Unexamined Patent Publication No. 6-190729. The grinding wheel Gc2 is directly supported on a wheel spindle 38 through a straight bore 27, and clamped with a wheel cap 21 by bolts 29. However, since the grinding wheel Gc2 is for grinding only one part of a workpiece at once, it can not solve the above drawback.

SUMMARY OF THE INVENTION

Accordingly, an object of the present invention is to provide an improved grinding wheel that gives high machining accuracy for simultaneously grinding at least two parts of a workpiece when a wheel spindle is driven at very high speed.

Another object of the present invention is to provide an improved grinding wheel, whose vibration is decreased when a wheel spindle is driven at very high speed.

A further object of the present invention is to provide an improved grinding wheel, whose imbalance is extremely low.

Briefly, a grinding wheel is for use in a grinding machine, and is attached on a wheel spindle of the grinding machine.

The grinding wheel includes at least two wheel cores. Each of wheel cores has a disk-like shape. An abrasive layer is disposed on a circumferential surface of each of the wheel cores. A spacer portion is inseparably fixed on at least one of the wheel cores for keeping a space between the abrasive layers of the wheel cores.

The number of separable parts of the grinding wheel are extremely decreased in consideration of imbalance of every part. The spacer portion is integral with at least one of the wheel cores, since the spacer portion is essential for keeping a space between the abrasive layers of the wheel cores. Therefore, the grinding wheel is easily accurately balanced.

Since the grinding wheel is accurately balanced, vibration of the grinding wheel is decreased and stability is enhanced when the wheel spindle is driven at very high speed. As a result, machining accuracy for grinding is enhanced.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENT

First Embodiment

Figure 1:
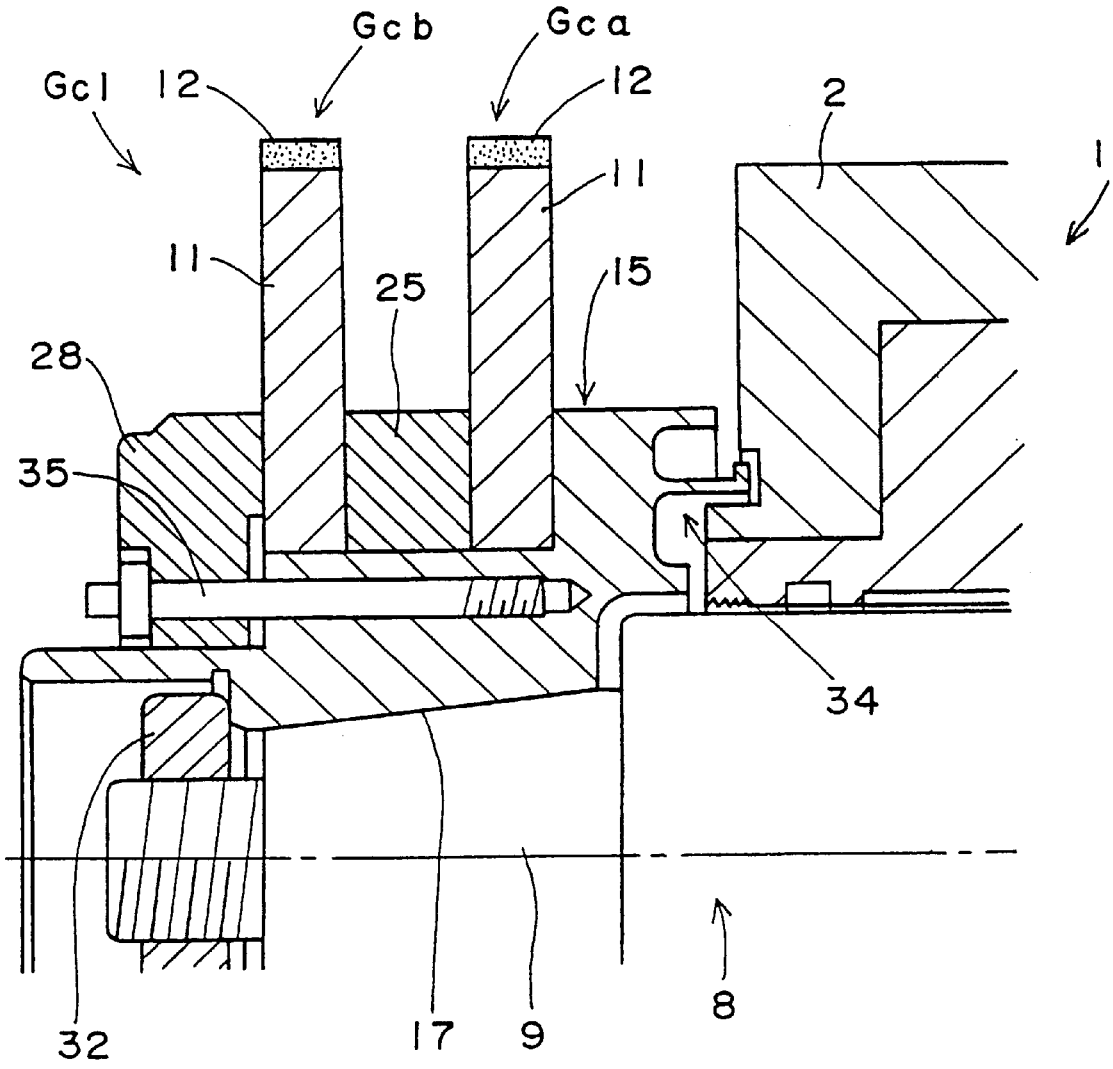
FIG. 1 (Prior Art)
FIG. 1 is a sectional view of a conventional grinding wheel.
Figure 2:
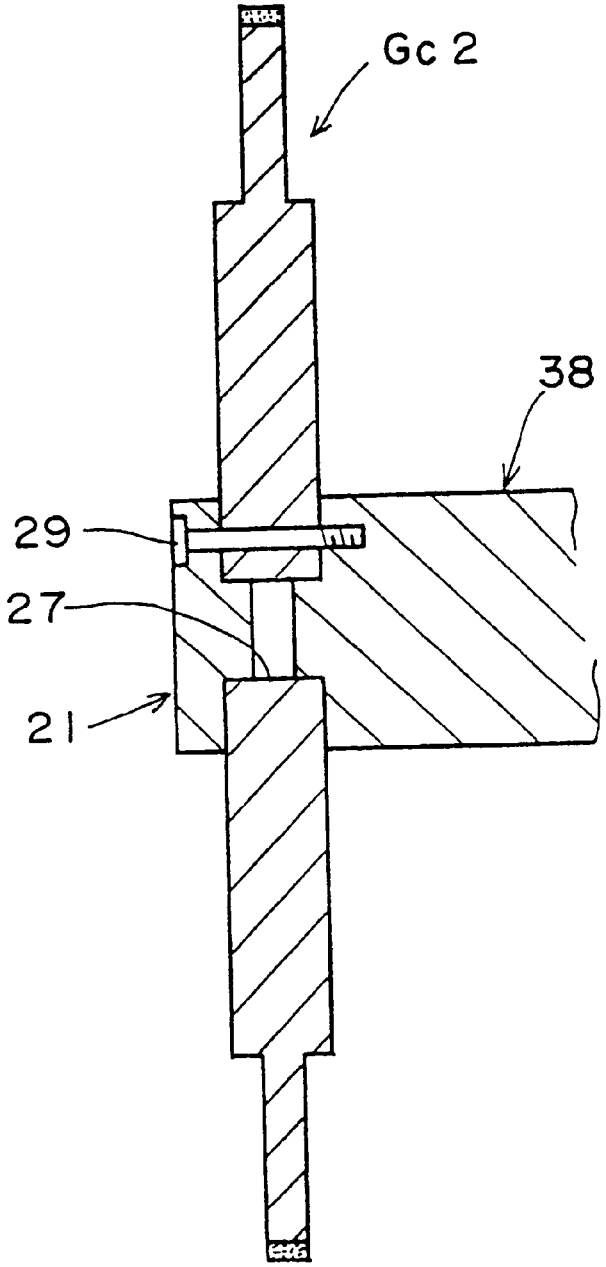
FIG. 2 (Prior Art)
FIG. 2 is a sectional view of another conventional grinding wheel.
Figure 3:
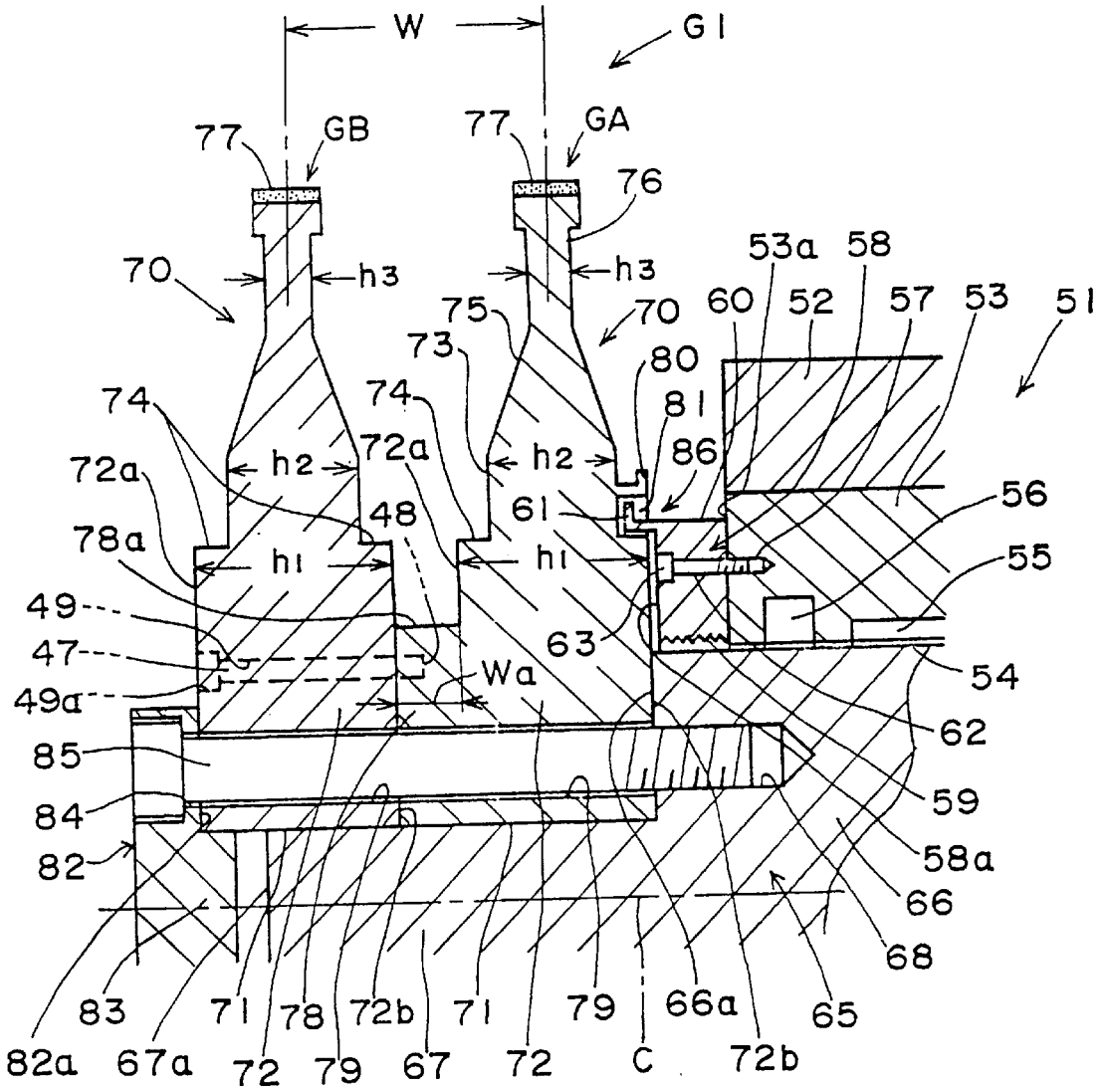
FIG. 3 is a sectional view of a first embodiment of a grinding wheel attached on a wheel head of a grinding machine according to the present invention.
Figure 4:
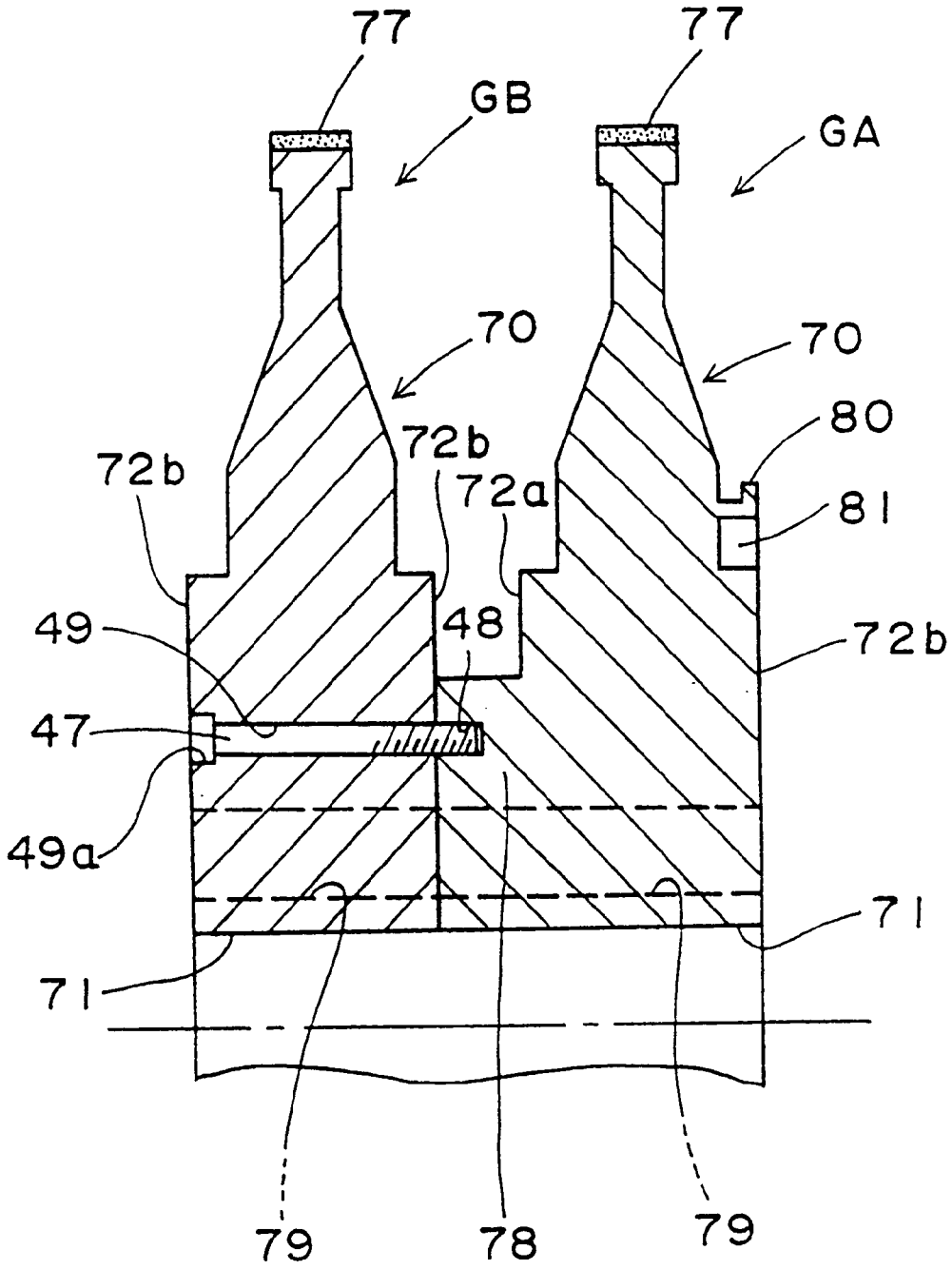
FIG. 4 is a sectional view of the grinding wheel of FIG. 3 before attached on the wheel head of the grinding machine.

Referring now to FIGS. 3 to 4, a first embodiment of the present invention is described hereinafter.

FIG. 3 is a sectional view of a grinding wheel G1 attached on a wheel head 52 of a grinding machine 51 The wheel head 52 of the grinding machine 51 includes a cylindrical bearing metal 53 for rotatably supporting a wheel spindle 65 and an unillustrated drive motor for rotating the wheel spindle 65 about a center axis C. A hydrostatic pressure pocket 55 and a drain groove 56 are formed on an inner surface 54 of the bearing metal 53. The hydrostatic pressure pocket 55 is supplied with pressurized fluid from an unillustrated fluid source for supporting the wheel spindle 65 by hydrostatic pressure. The drain groove 56 is utilized for draining the fluid overflowing from the hydrostatic pressure pocket 55. The fluid in the drain groove 56 gathers to an unillustrated drain tank, supplied to the hydrostatic pressure pocket 55 again.

Plural tapped holes 57 are formed by screw cutting at predetermined circumferential intervals on an outer end surface 53*a* of the bearing metal 53. A seal cap 58 is attached to the outer end surface 53*a* of the bearing metal 53 by clamp bolts 63 engaging with the tapped holes 57.

The seal cap 58 is formed in a circular shape with a predetermined thickness. An inner diameter of the seal cap 58 is approximately same as an inner diameter of the bearing metal 53. A screw portion 59 is formed on an inner surface of the seal cap 58, and has a thread formed in an opposite direction of a rotational direction of the wheel spindle 65. In the seal cap 58, a second protruding portion 61 (i.e., a second labyrinth portion) is formed on an outer edge, where an outer plane surface 58*a* and an outer circumferential surface 60 meet. The second protruding portion 61 is formed in a circular shape and formed approximately in an L-letter shape in its sectional view. The second protruding portion 61 forms a labyrinth seal 86 with a first protruding portion 80 and a ring groove 81 (i.e., a first labyrinth portion) described hereinafter. The labyrinth seal 86 is served as a grinding fluid prevention mechanism. If grinding fluid leaks into a clearance between the bearing metal 53 and the wheel spindle 65, the leaking grinding fluid changes the hydrostatic pressure in the hydrostatic pressure pocket 55. This state has a possibility that the wheel spindle 65 is supported by undesirable hydrostatic pressure. Therefore, the labyrinth seal 86, i.e., the grinding fluid prevention mechanism, prevents the grinding fluid from leaking into the wheel head 52.

Plural through holes 62 are bored at predetermined circumferential intervals in the seal cap 58 to correspond to the tapped holes 57, respectively. The through hole 62 is formed with a depressed hole for receiving a bolt head of the clamp bolt 63 to hide the bolt head in the seal cap 58. The seal cap 58 is attached on the bearing metal 53 by the clamp bolts 63 on condition that the clamp bolts 63 pass through the respective through holes 57 and engage with the tapped holes 57.

The wheel spindle 65 includes a large diameter portion 66 rotatably supported by the bearing metal 53, and a small diameter portion 67, diameter of which is smaller than that of the large diameter portion 66. The small diameter portion 67 expands with a predetermined length from an end surface 66*a* of the large diameter portion 66. Plural tapped holes 68 are formed on the end surface 66*a* of the large diameter portion 66 at predetermined circumferential intervals about the center axis C of the wheel spindle 65, and spaced a predetermined distance from the center axis C. The end surface 66*a* of the large diameter portion 66 slightly projects from the outer plane surface 58*a* of the seal cap 58, i.e., positions at slight outer side of the seal cap 58. The grinding wheel G1, consisting of two wheel disks GA and GB, is detachably attached on the small diameter portion 67 of the wheel spindle 65. The wheel disks GA and GB are spaced a predetermined distance W based on a distance between two worked portions of a workpiece.

The wheel disk GA includes a wheel core 70 and an abrasive layer 77. The wheel core 70 is formed in a disk-like shape with a predetermined diameter. A receiving bore 71 is formed straight at a center portion of the wheel core 70, and extends through the wheel core 70 for receiving the small diameter portion 67 of the wheel spindle 65. The receiving bore 71 is designed on the basis of the center axis of the wheel disk GA, so that the center axis of the wheel disk GA corresponds with the center axis C of the wheel spindle 65 when the wheel disk GA is attached on the wheel spindle 65.

The wheel core 70 consists of a boss portion 72, a middle portion 73, a taper portion 75 and a wheel portion 76, which are unitarily formed from the center axis of the wheel core 70 in this order. Each of these portions 72, 73, 75 and 76 is formed in a circular shape. The boss portion 72 includes the receiving bore 71 at the center portion thereof, and has a thickness h1. Each of side surfaces 72*a* and 72*b* of the boss portion 72 is formed in a plane, which is accurately designed to be perpendicular to the center axis of the wheel core 70. The middle portion 73 has a thickness h2 shorter than the thickness h1 of the boss portion 72. Each of side surfaces of the middle portion 73 is formed in a plane, which is designed to be perpendicular to the center axis of the wheel core 70. A shoulder portion 74 is formed between the boss portion 72 and the middle portion 73. The taper portion 75 has inclined side surfaces, and the thickness of the taper portion 75 gradually decreases from h2 to h3, outwardly. The wheel portion 76 having plane surfaces is formed approximately in a T-letter shape in its sectional view. The wheel portion 76 has a thickness h3 in the root portion extending from the taper portion 75. The abrasive layer 77 is fixed on a circumferential surface of the wheel portion 76. The abrasive layer 77 consists of plural grinding tips.

A spacer portion 78, having a thickness Wa, is unitarily formed on the side surface 72*a* of the boss portion 72 and abuts the wheel core 70 for keeping the distance W between the abrasive layers 77 of the wheel disks GA and GB. The spacer portion 78 is coaxially formed on the boss portion 72. An outer diameter of the spacer portion 78 is shorter than that of the boss portion 72, so that an outer surface 78*a* of the spacer portion 78 is located on the inside of the shoulder portion 74.

Plural through holes 79 are bored on the boss portion 72 at predetermined circumferential intervals about the center axis of the wheel core 70. Each of the through holes 79 penetrates the boss portion 72, also penetrates the spacer portion 78 for receiving a clamp bolt 85. Each of the through holes 79 respectively corresponds to the tapped holes 68 of the wheel spindle 65. And a diameter of the through hole 79 is a little longer than that of the clamp bolt 85, so that the clamp bolt 85 loosely passes through the through hole 79.

Plural tapped holes 48 are bored on the boss portion 72 by screw cutting for engaging with connecting bolts 47, respectively. The tapped holes 48 are located on the outer side of the through holes 79 at predetermined circumferential intervals about the center axis of the wheel core 70.

The first protruding portion 80 is formed on the side surface 72*b* of the boss portion 72 opposite to the spacer portion 78. The first protruding portion 80 has a circular shape and formed approximately in an L-letter shape in its sectional view. The ring groove 81 is circularly formed between the first protruding portion 80 and the shoulder portion 74 for receiving the second protruding portion 61 of the seal cap 58 attached on the bearing metal 53.

The wheel disk GB has two significant differences from the wheel disk GA. Parts of the wheel disk GB, which are substantially same as those of the wheel disk GA, are noted by the same numerals of the wheel disk GA. Therefore, a description of the wheel disk GB mainly shows the differences. And the description of the substantially same parts is omitted.

One difference between the wheel disks GA and GB is that the wheel disk GB has neither the spacer portion 78 nor the first protruding portion 80. The reason is that a wheel core 70 of the wheel disk GB is served as a common wheel core in no connection with the distance w between two wheel disks GA and GB. On the other hand, the wheel core 70 of the wheel disk GA is served as a spacing wheel core for keeping the distance W.

The other difference is that the wheel disk GB has plural through holes 49 instead of the tapped holes 48. The through holes 49 are bored on the boss portion 72 for receiving the connecting bolts 47, respectively. The through holes 49 are located on the outer side of the through holes 79, and are arranged at predetermined circumferential intervals about the center axis of the wheel core 70. Each of the through holes 49 penetrates the boss portion 72, and corresponds to each of the tapped holes 48 of the wheel disk GA when the wheel disks GA and GB are attached on the wheel spindle 65. Each of the through holes 49 has a depressed hole 49*a* for receiving the bolt head of connecting bolts 47 to hide the bolt head in the wheel disk GB.

The wheel cap 82 is formed in a circular shape with a predetermined thickness. An outer diameter of the wheel cap 82 is longer than that of the small diameter portion 67 of the wheel spindle 65 and shorter than that of the large diameter portion 66 of the wheel spindle 65. A projecting portion 83 is coaxially formed on one side surface of the wheel cap 82, and has a diameter approximately same size of that of the receiving bore 71 of the wheel disk GB with a predetermined tolerance. The side surface 82*a* except for the projecting portion 83 is designed to be accurately perpendicular to the center axis of the wheel cap 82, i.e., the center axis C of the wheel spindle 65. The projecting portion 83 is inserted into the receiving bore 71 of the wheel disk GB. Plural clamp holes 84 are bored on the wheel cap 82 at predetermined circumferential intervals about the center axis thereof. Each of the clamp holes 84 penetrates the wheel cap 82, and corresponds to the through hole 79 of the wheel disk GB when the wheel cap 82 is attached on the wheel disk GB. Each of the clamp holes 84 has a depressed hole for receiving the bolt head of the clamp bolt 85 to hide the bolt head in the wheel cap 82. Diameters of the clamp hole 84 and the depressed hole are respectively a little longer than diameters of clamp bolt 85 and its bolt head, so that the clamp bolt 85 loosely passes through the clamp hole 84 and the depressed hole.

The method of attaching the grinding wheel G1 on the wheel spindle 65 is described hereinafter. First, as shown in FIG. 4, the wheel disks GA and GB are clamped together by the connecting bolts 47. Next, the grinding wheel G1, i.e., the wheel disks GA and GB, are balanced in an unillustrated balancing machine before the grinding wheel G1 is attached on the wheel spindle 65 in the grinding machine. The balancing machine is situated out of the grinding machine and has a spindle for rotating the grinding wheel G1. The balancing machine detects an angle of an imbalanced point based on a reference point and an amount of imbalance while the balancing machine rotates the grinding wheel G1. When the balancing machine shows the imbalance of the grinding wheel G1, the imbalance is removed by, for example, drilling or cutting part of the wheel core 70 of the wheel disk GB. After removing the imbalance, the grinding wheel G1 is detached from the balancing machine.

Then, the grinding wheel G1 is attached on the wheel spindle 65, since the small diameter portion 67 of the wheel spindle 65 is inserted in the receiving bore 71. In this state, the first protruding portion 80 of the wheel disk GA faces the large diameter portion 66 of the wheel spindle 65. And the grinding wheel G1 is located on the wheel spindle 65 at the same phase angle that the grinding wheel G1 is attached on the spindle of the balancing machine. The reason is that new imbalance of the grinding wheel G1 is caused by the difference in the phase angle between the balancing machine and grinding machine. Therefore, the grinding wheel G1 has a landmark to indicate the phase angle in which the grinding wheel G1 is attached on the spindle of the balancing machine. When the grinding wheel G1 is attached on the wheel spindle 65 of the grinding machine, an operator refers to the landmark. For example, if the landmark indicates upward when the grinding wheel G1 is attached on the spindle of the balancing machine, the grinding wheel G1 is clamped on the wheel spindle 65 of the grinding machine on condition that the landmark indicates upward.

When the side surface 72*b* of the wheel disk GA is brought into contact with the end surface 66*a* of the wheel spindle 65, the second protruding portion 61 of the seal cap 58 is inserted into the ring groove 81 of the wheel disk GA, forming the labyrinth seal 86. A predetermined clearance is formed between the side surface 72*b* of the boss portion 72 and the outer plane surface 58*a* of the seal cap 58.

In this state, the side surface 72*a* of the wheel disk GB is located outside of the end surface 67*a* of the wheel spindle 65 to form a hole for receiving the projecting portion 83 of the wheel cap 82. Therefore,,the wheel cap 82 is attached on the wheel disk GB.

Finally, the clamp bolt 85 is inserted into the clamp hole 84 of the wheel cap 82, the through holes 79 of the wheel disks GA and GB, and the tapped hole 68 of the wheel spindle 65 on condition that these holes 85, 79 and 68 correspond one another. As a result, the grinding wheel G1, i.e., wheel disks GA and GB, is bolted on the wheel spindle 65, spaced the distance w by the spacer portion 78, The grinding wheel G1 is mainly supported between the end surface 66*a* of the wheel spindle 65 and the side surface 82*a* of the wheel cap 82 designed to be accurately perpendicular to the center axis C of the wheel spindle 65.

As described above, the grinding wheel G1, including wheel disks GA and GB, of the first embodiment is directly attached on the small diameter portion 67 of the wheel spindle 65 through the straight receiving bore 71. The straight receiving bore 71 is not easily widen radially by reason of centrifugal force, compared with the taper bore of the conventional grinding wheel when the wheel spindle 65 is driven at very high speed. Owing to the direct attachment and the straight receiving bore 71, the grinding wheel G1 is firmly uniformly fixed on the wheel spindle 65, enhancing a rotational stability and a machining accuracy even when the wheel spindle 65 is driven at very high speed.

Each of the wheel disks GA and GB includes the boss portion 72 with the thickness h1, the middle portion 73 with the thickness h2, the taper portion 75, and a wheel portion 76, formed approximately a T-letter shape in the sectional view, with the thickness h3. The boss portion 72, the middle portion 73, the taper portion 75 and a wheel portion 76 are radially formed from the center axis of the grinding wheel G1 in this order, the thicknesses of which are designed to be h3<h2<h1. This shape of the wheel disks GA and GB decreases the weight of the wheel disks GA and GB with keeping the rigidity thereof.

One of the wheel disks GA and GB, i.e., the wheel disk GA, has the spacer portion 78 integral with the wheel core 70 instead of a separable spacer. This configuration causes that vibration of the grinding wheel G1 is decreased because the spacer portion 78 is easily balanced together with the wheel disks GA and GB As a result, since the grinding wheel G1 is accurately balanced even when the wheel spindle 65 is driven at very high speed for simultaneously grinding two parts of a workpiece, the machining accuracy is enhanced. For example, the wheel spindle 65 is driven at approximately 200 m/s in wheel surface speed.

The wheel disk GA also has the first protruding portion 80 for the labyrinth seal 86 integral with the wheel core 70. This configuration causes that the vibration of the grinding wheel G1 is decreased by a similar reason to that of the spacer portion 78, i.e., the first protruding portion 80 is easily balanced together with the wheel disks GA and GB. Therefore, the machining accuracy is enhanced under very high speed of the wheel spindle 65.

In the labyrinth seal 86, the second protruding portion 61 is formed on the seal cap 58 detachably attached on the wheel head 52 with the clamp bolts 63. By modifying of the thickness of the seal cap 58 or using another seal cap 58 having a different thickness, a clearance between the second protruding portion 61 and the ring groove 81 is easily changed to regulate a sealing performance of the labyrinth seal 86.

The other of the wheel disks GA and GB, i.e., the wheel disk GB, has neither the spacer portion 78 nor the first protruding portion 80. The wheel disk GB is used as a common wheel disk regardless of the distance W between the wheel disks GA and GB. Therefore, the manufacturing cost of the wheel disk G1 is decreased.

Second Embodiment

Figure 5:
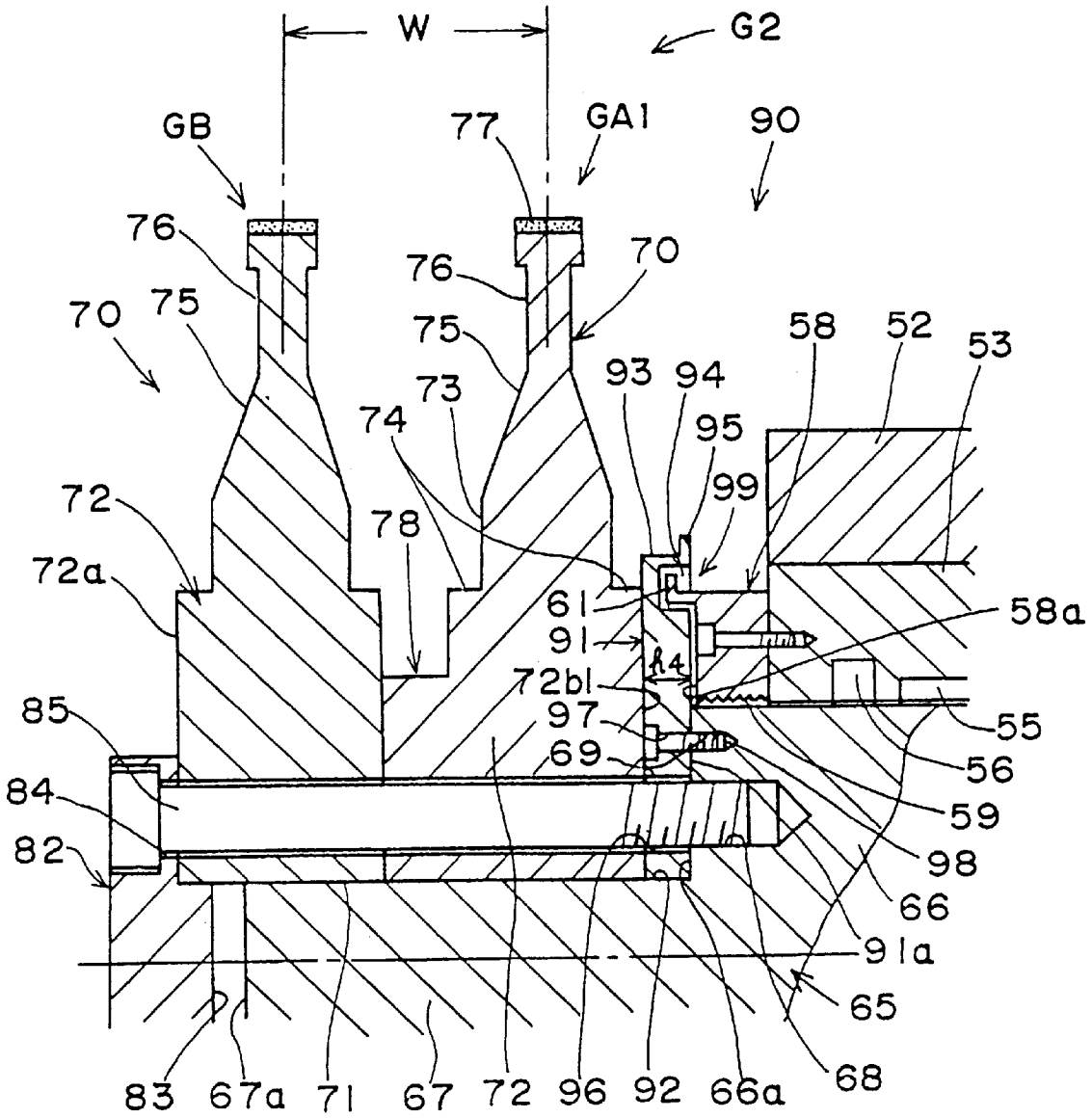
FIG. 5 is a sectional view of a second embodiment of a grinding wheel attached on a wheel head of a grinding machine according to the present invention.

FIG. 5 shows another preferred embodiment of a grinding wheel G2 according to the invention, which has a significant difference from the first embodiment of the grinding wheel G1 previously described. FIG. 5 is comparable to FIG. 3 for the first embodiment. Parts of the second embodiment, substantially same as those of the first embodiment, are noted by the same numerals of the first embodiment. Therefore, the description of these parts in the second embodiment is omitted. The other parts of the second embodiment, different from those of the first embodiment, are noted by different reference numerals.

The difference of the second embodiment is that a ring cap 91 is separably arranged on a wheel disk GA1 comparable to the wheel disk GA in the first embodiment. The ring cap 91 includes a first protruding portion 95 and a ring groove 94, which are respectively comparable to the first protruding portion 80 and the ring groove 81, inseparably formed on the wheel disk GA, in the first embodiment. The wheel disk GA1 has a plane side surface 72*b*1. The other elements of the wheel disk GA1 are substantially same as those of the wheel disk GA.

The ring cap 91 is supported on the small diameter portion 67 on the wheel spindle 65 between the wheel disk GA1 and the large diameter portion 66 of the wheel spindle 65 The ring cap 91 is formed in a circular shape with a thickness h4. A receiving bore 92 is formed at the center portion thereof. The diameter of the receiving bore 92 is approximately same as that of the small diameter portion 67 on the wheel spindle 65 with a predetermined tolerance. The outer circumferential surface 93 of the ring cap 91 is located outside of the shoulder portion 74 of the wheel disk GA1 on condition that the ring cap 91 and the wheel disk GA1 are supported on the wheel spindle 65.

A ring groove 94 is circularly formed on a side surface 91*a* of the ring cap 91 for receiving the second protruding portion 61 of the seal cap 58. The side surface 91*a* is in contact with the end surface 66*a* of the large diameter portion 66 of the wheel spindle 65. The first protruding portion 95 is formed on the outer circumferential surface 93 of the ring cap 91. The first protruding portion 95 faces the side of the seal cap 58 The first protruding portion 95 and the ring groove 94 are served as a first labyrinth portion.

Plural through holes 96 are bored on the ring cap 91 at predetermined circumferential intervals about the center axis thereof. The through holes 96 penetrate the ring cap 91 for receiving the clamp bolt 85. Each of the through holes 96 respectively corresponds to each of the tapped holes 68 of the wheel spindle 65. And a diameter of the through hole 96 is a little longer than that of the clamp bolt 85, so that the clamp bolt 85 loosely passes through the through hole 96.

Plural clamp holes 97 are bored on the ring cap 91 at predetermined circumferential intervals about the center axis thereof. Plural clamp holes 97 are located on the outer side of the through holes 96 in the ring cap 91. The clamp holes 97 penetrate the ring cap 91 for receiving the clamp bolt 98. Each of the clamp holes 97 has a depressed hole for receiving the bolt head of the clamp bolt 98. Each of the clamp holes 97 respectively corresponds to each of tapped holes 69. The tapped holes 69 are formed at predetermined circumferential intervals on the end surface 66*a* of the large diameter portion 66 of the wheel spindle 65.

The method of attaching the grinding wheel G2 on the wheel spindle 65 is described hereinafter. First, the ring cap 91 is attached on the wheel spindle 65, since the receiving bore 92 receives the small diameter portion 67 of the wheel spindle 65. The ring cap 91 is clamped on the wheel spindle 65 by the clamp bolts 98 on condition that the side surface 91*a* of the ring cap 91 faces the large diameter portion 66 of the wheel spindle 65. At this time, the second protruding portion 61 of the seal cap 58 is inserted into the ring groove 94 of the seal cap 58, forming the labyrinth seal 99 served as grinding fluid prevention mechanism. A predetermined clearance is formed between the side surface 91*a* of the ring cap 91 and the outer plane surface 58*a* of the seal cap 58.

Next, the wheel disks GA1 and GB are attached on the wheel spindle 65 like the first embodiment. In this state, the side surface 72*a* of the wheel disk GB is located outside of the end surface 67*a* of the wheel spindle 65 to form a hole for receiving the projecting portion 83 of the wheel cap 82. Therefore, the wheel cap 82 is attached on the wheel disk GB in the receiving bore 71.

Finally, the clamp bolt 85 is inserted into the clamp hole 84 of the wheel cap 82, the through holes 79 of the wheel disks GA1 and GB, the through holes 96 in the ring cap 91, and the tapped hole 68 of the wheel spindle 65 on condition that these holes 84, 79, 96 and 68 correspond one another. As a result, the wheel disks GA1 and GB are bolted on the wheel spindle 65, spaced the distance W by the spacer portion 78.

The grinding wheel G2 of the second embodiment described above has the operation and the effect which are substantially same as the grinding wheel G1 of the first embodiment. In addition, because the ring cap 91 is separated from the wheel disk GA1, the sealing performance of the labyrinth seal 99 is easily adjusted by changing the clearance between the ring groove 94 of the ring cap 91 and the second protruding portion 61 of the seal cap 58.

Third Embodiment

Figure 6:
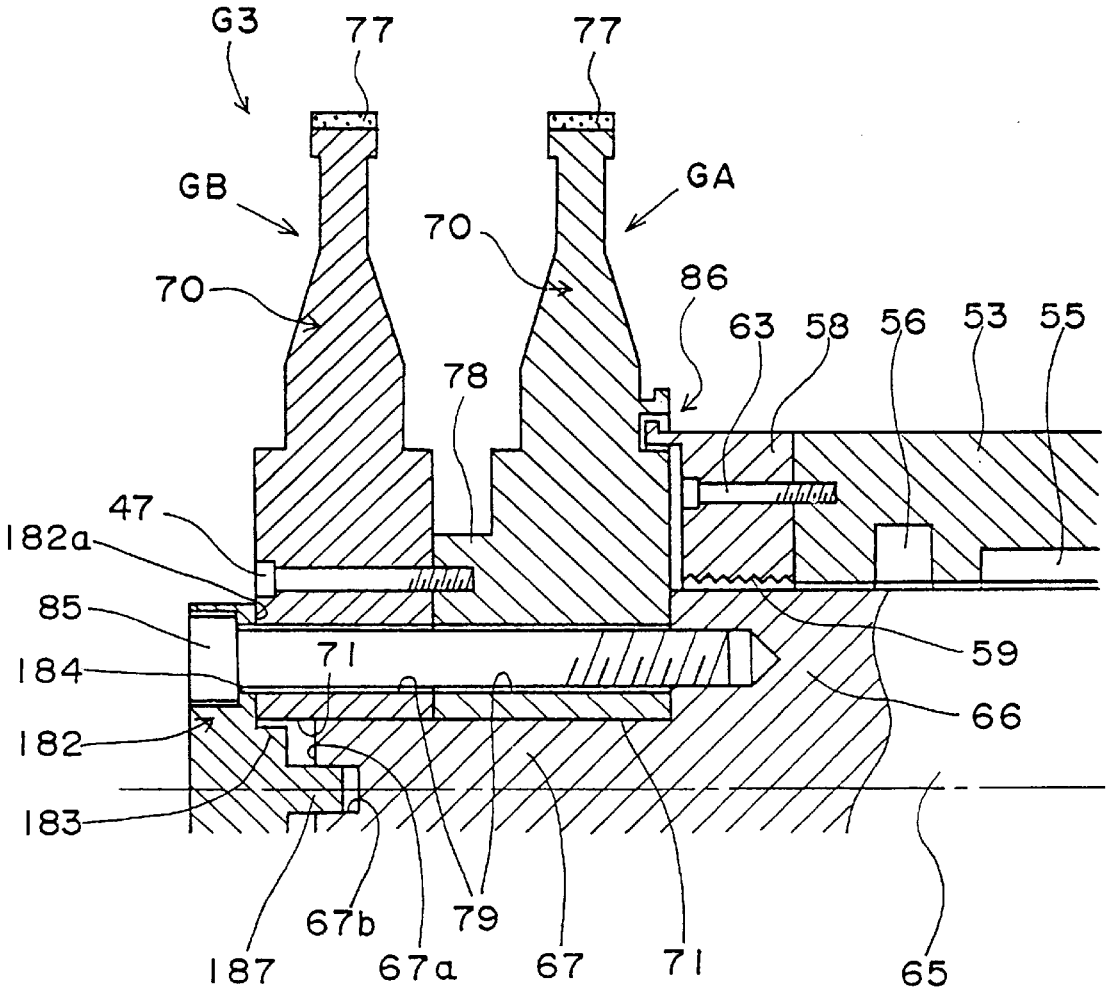
FIG. 6 is a sectional view of a third embodiment of a grinding wheel attached on a wheel head of a grinding machine according to the present invention.

FIG. 6 shows another preferred embodiment of a grinding wheel G3 according to the invention, which has a significant difference from the first embodiment of the grinding wheel G1 previously described. FIG. 6 is comparable to FIG. 3 for the first embodiment. Parts of the third embodiment, substantially same as those of the first embodiment, are noted by the same numerals of the first embodiment. Therefore, the description of these parts in the third embodiment is omitted. The other parts of the third embodiment, different from those of the first embodiment, are noted by different reference numerals.

The difference of the third embodiment is a wheel cap 182 comparable to the wheel cap 82 of the first embodiment. The wheel cap 182 is formed in a circular shape with a predetermined thickness. An outer diameter of the wheel cap 182 is longer than that of the small diameter portion 67 of the wheel spindle 65 and shorter than that of the large diameter portion 66 of the wheel spindle 65. A projecting portion 183 is coaxially formed on one side surface of the wheel cap 182. A diameter of the projecting portion 183 is a little shorter than that of the receiving bore 71 of the wheel disk GB, so that the projecting portion 83 is loosely inserted into the receiving bore 71 of the wheel disk GB.

A center portion 187 is coaxially formed on projecting portion 183. On the other hand, a center hole 67*b* is coaxially formed on the end surface 67*a* of the wheel spindle 65. A diameter of the center portion 187 is approximately same as that of the center hole 67*b* of the wheel spindle 65 with a predetermined tolerance. When the center portion 187 is fitted in the center hole 67*b,* the center axis of the wheel cap 182 is positioned at the center axis C of the wheel spindle 65.

The side surface 182*a* except for the projecting portion 183 is designed to be accurately perpendicular to the center axis of the wheel cap 182, i.e., the center axis C of the wheel spindle 65. Plural clamp holes 184 are bored on the wheel cap 182 at predetermined circumferential intervals about the center axis thereof. Each of the clamp holes 184 penetrates the wheel cap 182, and corresponds to the through hole 79 of the wheel disk GB when the wheel cap 182 is attached on the wheel disk GB. Each of the clamp holes 184 has a depressed hole for receiving the bolt head of the clamp bolt 85 to hide the bolt head in the wheel cap 182. Diameters of the clamp hole 84 and the depressed hole are respectively a little bigger than diameters of clamp bolt 85 and its bolt head, so that the clamp bolt 85 loosely passes through the clamp hole 184 and the depressed hole.

The imbalance of the grinding wheel G3 of the third embodiment is extremely small because the wheel cap 182 is attached on the basis of the center axis c of the wheel spindle 65. And compared with the first embodiment, a possibility of the imbalance of the third embodiment is also smaller than that of the first embodiment. The possible imbalance of the grinding wheel G3 of the third embodiment is based on a deviation between the center portion 187 of the wheel cap 182 and the center hole 67*b* of the wheel spindle 65 when the grinding wheel G3 is driven by the wheel spindle 65.

On the other hand, the possible imbalance of the grinding wheel G1 of the first embodiment is based on the sum of two kinds of deviations when the grinding wheel G1 is driven by the wheel spindle 65. One is a deviation between the projecting portion 83 of the wheel cap 82 and the receiving bore 71 of the wheel disk GB. The other is a deviation between the receiving bore 71 of the wheel disk GB and the small diameter portion 67 of the wheel spindle 65. Therefore, the third embodiment decreases the imbalance of the grinding wheel G3 compared with the first embodiment. The third embodiment permits greater accuracy and superior machined surface of the workpiece.

Figure 7:
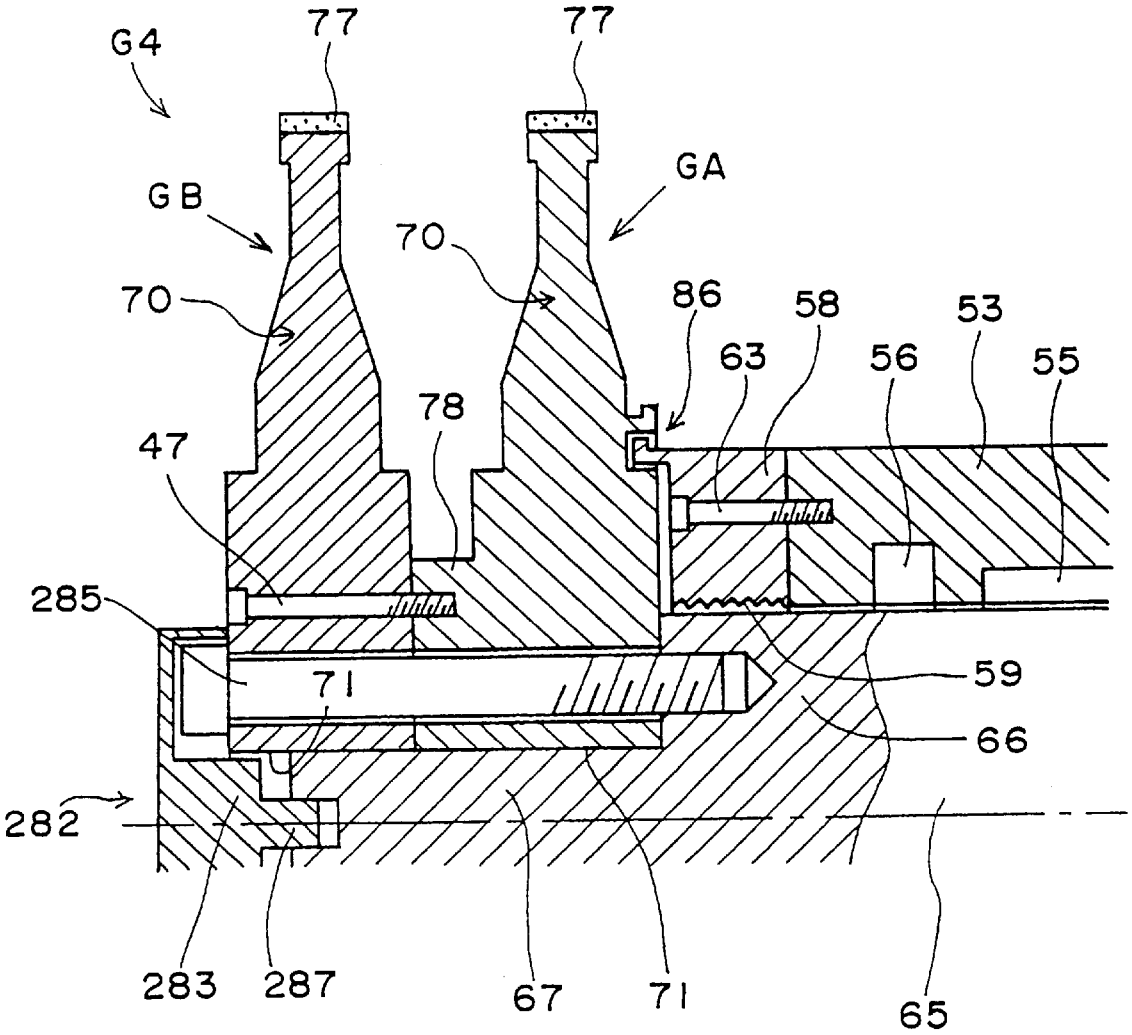
FIG. 7 is a sectional view of a modification of the third embodiment of the grinding wheel attached on the wheel head of the grinding machine.

FIG. 7 shows a modification of the wheel cap 182 of the third embodiment. A grinding wheel G4 in FIG. 7 is directly clamped by clamp bolts 285. In this case, a wheel cap 262, comparable to the wheel cap 182, covers up bolt heads of the clamp bolts 285. The projecting portion 283 and the center portion 287 is formed in the similar way to the third embodiment of FIG. 6. Therefore, the modification also decreases the imbalance of the grinding wheel G4.

Other Modifications

Other modifications are described in the similar way to the embodiments described above.

In the first embodiment, the grinding wheel G1 has two wheel disks GA and GB. The wheel disk GA has the first protruding portion 80 and the ring groove 81, which are inseparably formed on the wheel disk GA for the labyrinth seal 86. However, the inseparable first protruding portion 80 and the ring groove 81 are effective in the balancing, even if the grinding wheel consists of only one wheel disk shown in FIGS. 8 and 9.

Figure 8:
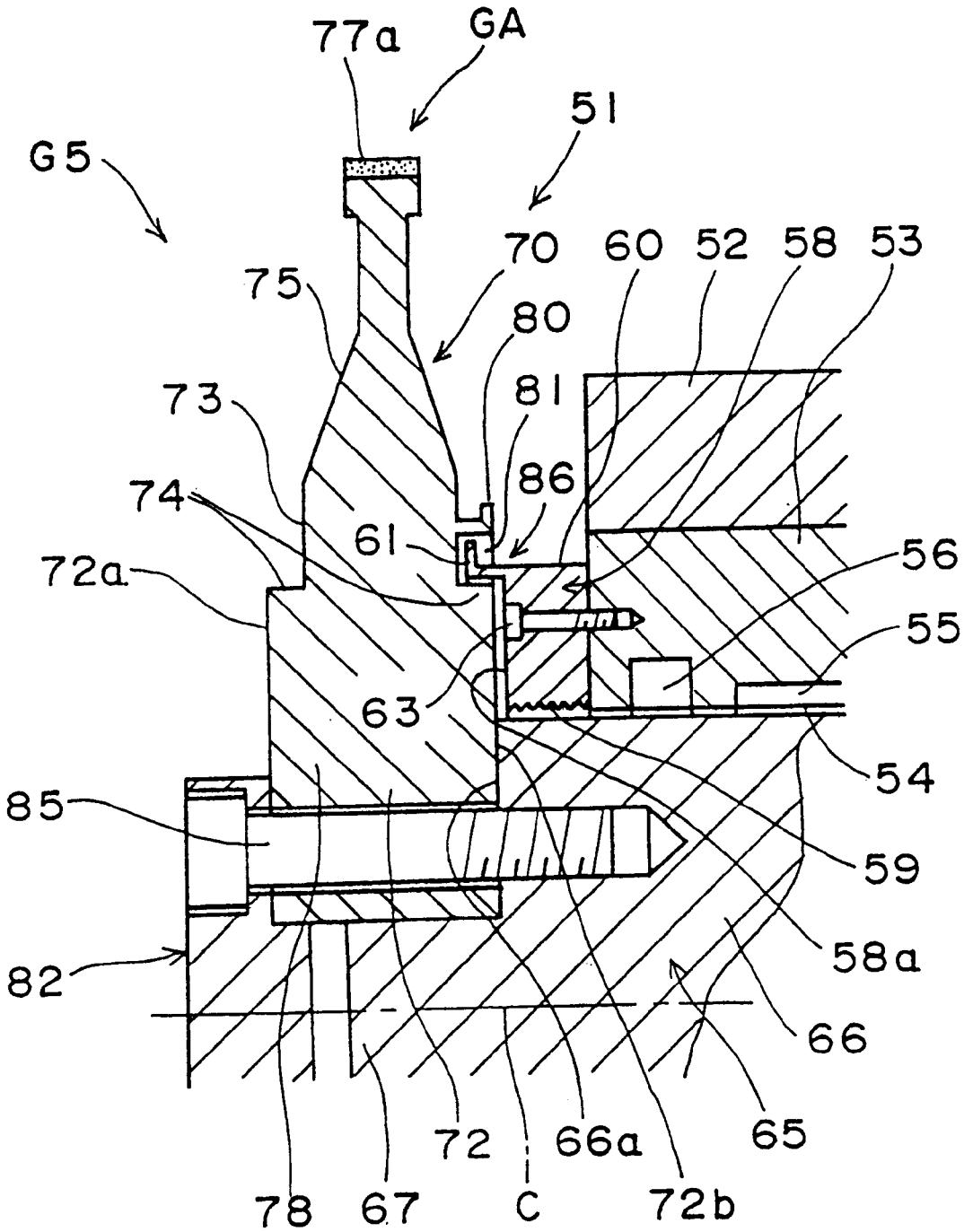
FIG. 8 is a sectional view of anther modification of a grinding wheel attached on a wheel head of a grinding machine according to the present invention.
Figure 9:
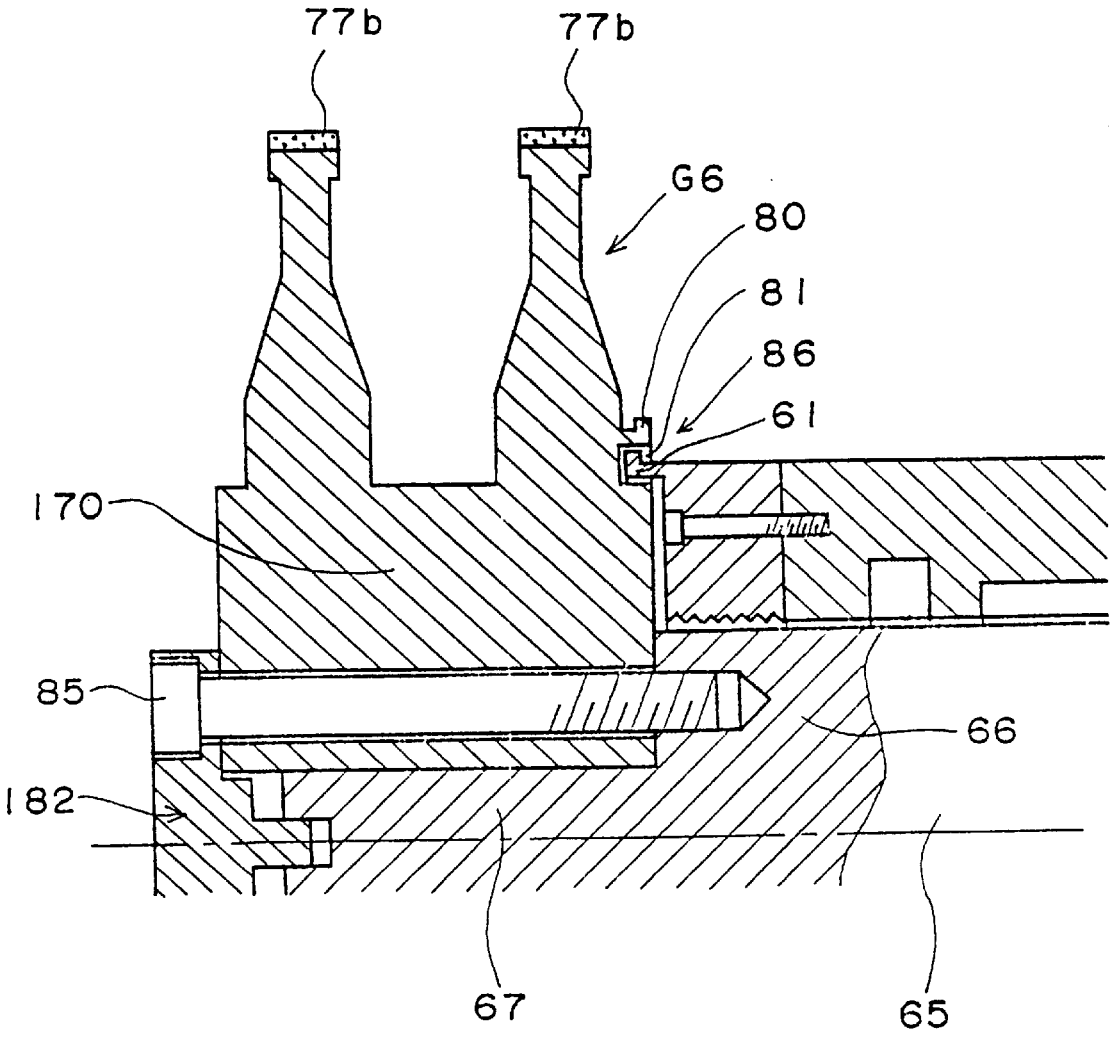
FIG. 9 is a sectional view of a further modification of a grinding wheel attached on a wheel head of a grinding machine according to the present invention.

The grinding wheel G5 has one abrasive layer 77*a* in FIG. 8. And the grinding wheel G6 has two abrasive layers 77*b* formed on a wheel core 170 in FIG. 9.

In the first embodiment, only one wheel disk GA has the spacer portion 78 on the boss portion 78 of the wheel disks GA. The reason is that the other wheel disk GB is served as the common wheel disk in no connection with the distance W between two wheel disks GA and GB. However, it the other wheel disk GB is not served as the common wheel disk, the other wheel disk GB also has a spacer portion 78 on the boss portion 72.

In addition, in the first embodiment, the grinding wheel G1 consists of two wheel disks GA and GB. However, the grinding wheel G1 can consist of three, or more wheel disks. In this case, both side surfaces 72*a* and 72*b* of the wheel disk GA or GB can have the spacer portion 78, though only one side surface 72*a* of the wheel disk GA in the first embodiment has the spacer portion 78.

What is claimed is:

1. A grinding wheel for use in a grinding machine, said grinding wheel attached on a wheel spindle of said grinding machine for rotating said grinding wheel about a rotational axis for simultaneously grinding at least two parts of a workpiece, said grinding abutting wheel comprising;

at least two wheel cores, each of which has a disk-like shape;

an abrasive layer disposed on a circumferential surface of each of said wheel cores; and a spacer portion unitarily provided an extending along said rotational axis on at least one of said wheel cores for maintaining a space between said abrasive layers of said wheel cores.

2. The grinding wheel according to claim 1, wherein at least one of said wheel cores has a receiving bore at the center thereof for receiving said wheel spindle of said grinding machine.

3. The grinding wheel according to claim 2, wherein said receiving bore is formed in a straight cylindrical shape.

4. The grinding wheel according to claim 2, wherein said wheel cores are clamped on said wheel spindle of said grinding machine through a wheel cap by a bolt; said wheel cap is attached on one of side surfaces of one of said wheel cores; and said wheel cap is based on a center axis of said receiving bore of said wheel core.

5. The grinding wheel according to claim 2, wherein said wheel cores are directly clamped on said wheel spindle of said grinding machine by a bolt, a bolt head of which is covered by a wheel cap; said wheel cap is attached on one of side surfaces of one of said wheel cores; and said wheel cap is based on a center axis of said receiving bore of said wheel core.

6. The grinding wheel according to claim 1, wherein one of said wheel cores has said spacer portion, and the other of said wheel cores does not have said spacer portion.

7. The grinding wheel according to claim 1, wherein said wheel cores are attached on said wheel spindle of said grinding machine after said wheel cores are balanced when said wheel cores are fixed each other.

8. The grinding wheel according to claim 1, the grinding wheel further comprising: a first labyrinth portion located on one of side surfaces of one of said wheel cores for forming a labyrinth seal with a second labyrinth portion arranged on said grinding machine.

9. The grinding wheel according to claim 8, wherein said first labyrinth portion is unitarily provided on the side surface of said wheel core.

10. The grinding wheel according to claim 8, wherein said first labyrinth portion is formed on a ring cap separably arranged on the side surface of said wheel core.

11. The grinding wheel according to claim 1, wherein said wheel cores are clamped on said wheel spindle of said grinding machine through a wheel cap by a bolt.

12. The grinding wheel according to claim 11, wherein said wheel cap is attached on one of side surfaces of one of said wheel cores, and said wheel cap is based on a center axis of said wheel spindle of said grinding machine.

13. The grinding wheel according to claim 1, wherein said wheel cores are directly clamped on said wheel spindle of said grinding machine by a bolt, a bolt head of which is covered by a wheel cap.

14. The grinding wheel according to claim 13, wherein said wheel cap is attached on one of side surfaces of one of said wheel cores, and said wheel cap is based on a center axis of said wheel spindle of said grinding machine.

15. The grinding wheel according to claim 1, wherein said wheel cores are each one piece wheel cores.

16. A grinding wheel for use in a grinding machine, said grinding wheel attached on a wheel spindle of said grinding machine for rotating said grinding wheel about a rotational axis for simultaneously grinding at least two parts of a workpiece, said grinding wheel comprising:

a spacing wheel core having a disk-like shape, said spacing wheel core including a spacer portion unitarily provided on a side surface of said spacing wheel core and extending along said rotational axis, a first abrasive layer disposed on a circumferential surface of said spacing wheel core; and a common wheel core having a disk-like shape, said common wheel core abutting said spacer portion and including a second abrasive layer disposed on a circumferential surface of said common wheel core, said second abrasive layer being spaced from said first abrasive layer by said spacer portion of said spacing wheel core.

17. The grinding wheel according to claim 16, wherein each of said spacing and said common wheel cores has a receiving bore at the center thereof for receiving said wheel spindle of said grinding machine.

18. The grinding wheel according to claim 17, wherein said receiving bore is formed in a straight cylindrical shape.

19. The grinding wheel according to claim 16, wherein said spacing wheel core and said common wheel core are attached on said wheel spindle of said grinding machine after said spacing wheel core and said common wheel core are balanced when said spacing wheel core and said common wheel core are fixed each other.

20. The grinding wheel according to claim 17, wherein said spacing and said common wheel cores are clamped on said wheel spindle of said grinding machine through a wheel cap by a bolt; said wheel cap is attached on one of side surfaces of said common wheel core; and said wheel cap is based on a center axis of said receiving bore of said common wheel core.

21. The grinding wheel according to claim 17, wherein said spacing and said common wheel cores are directly clamped on said wheel spindle of said grinding machine by a bolt, a bolt head of which is covered by a wheel cap; said wheel cap is attached on one of side surfaces of said common wheel core; and said wheel cap is based on a center axis of said receiving bore of said common wheel core.

22. The grinding wheel according to claim 16, the grinding wheel further comprising: a first labyrinth portion located on one of side surfaces of said spacing wheel core and said common wheel core for forming a labyrinth seal with a second labyrinth portion arranged-on said grinding machine.

23. The grinding wheel according to claim 22, wherein said first labyrinth portion is formed on a side surface, opposite to said spacer portion, of said spacing wheel core.

24. The grinding wheel according to claim 22, wherein said first labyrinth portion is formed on a ring cap separably arranged on the side surface, opposite to said spacer portion, of said spacing wheel core.

25. The grinding wheel according to claim 16, wherein said spacing and said common wheel cores are clamped on said wheel spindle of said grinding machine through a wheel cap by a bolt.

26. The grinding wheel according to claim 25, wherein said wheel cap is attached on one of side surfaces of said common wheel core, and said wheel cap is based on a center axis of said wheel spindle of said grinding machine.

27. The grinding wheel according to claim 16, wherein said spacing and said common wheel cores are directly clamped on said wheel spindle of said grinding machine by a bolt, a bolt head of which is covered by a wheel cap.

28. The grinding wheel according to claim 27, wherein said wheel cap is attached on one of side surfaces of said common wheel core, and said wheel cap is based on a center axis of said wheel spindle of said grinding machine.

29. The grinding wheel according to claim 16, wherein said wheel cores are each one piece wheel cores.

30. A grinding wheel mounted to a wheel spindle of a grinding machine, rotating said grinding wheel about a rotational axis for the grinding wheel comprising:

a one piece spacing wheel core having a disk-like shape and a spacer portion unitarily provided on a side surface thereof and extending along said rotational axis;

a first abrasive layer provided on a circumferential surface of said spacing wheel core;

a one piece common wheel core having a disk-like shape, said common wheel core directly abutting said spacer portion such that said spacer portion separates said common wheel core from said spacing wheel core; and a second abrasive layer provided on a circumferential surface of said common wheel core.

* * * * *